US010400788B2

(12) United States Patent
Nakaniwa et al.

(10) Patent No.: US 10,400,788 B2
(45) Date of Patent: Sep. 3, 2019

(54) INTERMEDIATE INTAKE-TYPE DIAPHRAGM AND CENTRIFUGAL ROTATING MACHINE

(71) Applicant: MITSUBISHI HEAVY INDUSTRIES COMPRESSOR CORPORATION, Tokyo (JP)

(72) Inventors: Akihiro Nakaniwa, Tokyo (JP); Shinji Iwamoto, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 441 days.

(21) Appl. No.: 15/109,179

(22) PCT Filed: Feb. 5, 2015

(86) PCT No.: PCT/JP2015/053217
§ 371 (c)(1),
(2) Date: Jun. 30, 2016

(87) PCT Pub. No.: WO2015/119189
PCT Pub. Date: Aug. 13, 2015

(65) Prior Publication Data

US 2016/0327056 A1 Nov. 10, 2016

(30) Foreign Application Priority Data

Feb. 6, 2014 (JP) ..... 2014-021456

(51) Int. Cl.
*F04D 17/12* (2006.01)
*F04D 29/44* (2006.01)
(Continued)

(52) U.S. Cl.
CPC ..... *F04D 29/44* (2013.01); *F04D 17/12* (2013.01); *F04D 17/122* (2013.01);
(Continued)

(58) Field of Classification Search
CPC .... F04D 17/12; F04D 17/122; F04D 27/0238; F04D 29/44; F04D 29/4213
See application file for complete search history.

(56) References Cited

U.S. PATENT DOCUMENTS 4,725,196 A 2/1988 Kaneki et al.
7,641,439 B2 * 1/2010 Chen ..... F04D 29/441 415/116

(Continued)

FOREIGN PATENT DOCUMENTS

GB 879320 A * 10/1961 ..... F04D 17/122
JP 57-206800 A 12/1982

(Continued)

OTHER PUBLICATIONS

Japanese Notification of Information Statement for Japanese Application No. 2014-021456, dated Nov. 1, 2016, with an English translation.

(Continued)

*Primary Examiner* — Woody A Lee, Jr.
(74) *Attorney, Agent, or Firm* — Birch, Stewart, Kolasch & Birch, LLP

(57) ABSTRACT

An intermediate intake-type diaphragm includes a flow-regulating vane that is provided in an introduction flow channel to regulate a first fluid to flow along the radial direction; and a partition wall that partitions the introduction flow channel and an intermediate suction flow channel in the direction of an axial line. A radially inner end portion of the partition wall is located further on a radially inner side than a radially outer end portion of the flow-regulating vane, and further on a radially outer side than a boundary between the introduction flow channel and a curved flow channel.

7 Claims, 6 Drawing Sheets

(51) Int. Cl.
*F04D 27/02* (2006.01)
*F04D 29/42* (2006.01)

(52) U.S. Cl.
CPC ..... *F04D 27/0238* (2013.01); *F04D 29/4213* (2013.01); *F04D 29/444* (2013.01); *F05D 2250/51* (2013.01)

(56) References Cited

U.S. PATENT DOCUMENTS

| | | | | |
|---|---|---|---|---|
| 2007/0140889 | A1 | 6/2007 | Chen et al. | |
| 2010/0232984 | A1* | 9/2010 | Bade | F04D 13/10 417/53 |
| 2013/0259644 | A1 | 10/2013 | Kobayashi et al. | |
| 2015/0354588 | A1* | 12/2015 | Yamashita | F04D 29/441 415/204 |

FOREIGN PATENT DOCUMENTS

| | | | | | |
|---|---|---|---|---|---|
| JP | 63-75393 | A | | 4/1988 | |
| JP | 8-200296 | A | | 8/1996 | |
| JP | 08200296 | A | * | 8/1996 | F04D 17/122 |
| JP | 9-144698 | A | | 6/1997 | |
| JP | 2002-327700 | A | | 11/2002 | |
| JP | 2009-19601 | A | | 1/2009 | |
| JP | 2010185361 | A | * | 8/2010 | F04D 17/122 |
| JP | 2010-285927 | A | | 12/2010 | |
| JP | 2012-87646 | A | | 5/2012 | |
| JP | 4940755 | B2 | | 5/2012 | |
| JP | 2012-515876 | A | | 7/2012 | |
| WO | WO 2010/084422 | A2 | | 7/2010 | |

OTHER PUBLICATIONS

International Search Report and Written Opinion of the International Searching Authority (Forms PCT/ISA/210 and PCT/ISA/237) dated Apr. 28, 2015, for International Application No. PCT/JP2015/053217 with the English translation.

* cited by examiner

INTERMEDIATE INTAKE-TYPE DIAPHRAGM AND CENTRIFUGAL ROTATING MACHINE

TECHNICAL FIELD

The present invention relates to an intermediate intake-type diaphragm and a centrifugal rotating machine.

Priority is claimed on Japanese Patent Application No. 2014-021456, filed Feb. 6, 2014, the content of which is incorporated herein by reference.

BACKGROUND ART

For example, multistage centrifugal compressors are known as a type of centrifugal rotating machine, and an example of the multistage centrifugal compressor is disclosed in Patent Literature 1. Patent Literature 1 discloses a compressor that includes a U-shaped cross-section portion from which a working gas compressed at a first stage impeller and a second stage impeller is discharged, a return flow channel portion in which the working gas after passing through the U-shaped cross-section portion joins with an intermediate stage injection flow suctioned from an intermediate stage injection nozzle and flows radially inward, and a third stage impeller to which the working gas (working gas joined with the intermediate stage injection flow) of the flow directed into an axial direction from a radially inward direction is supplied.

Suction of the intermediate stage injection flow is applied to a compressor used in a refrigeration cycle or the like and is intended to adjust the flow rate required for the cycle.

CITATION LIST

Patent Literature

[Patent Literature 1]
Japanese Patent No. 4940755

SUMMARY OF INVENTION

Technical Problem

In a multistage centrifugal compressor described in Patent Literature 1, the working gas compressed in the first stage impeller and the second stage impeller has a swirling component caused by the rotation or the like of the impellers. For this reason, a flow direction is different between the working gas and the intermediate stage injection flow (hereinafter, referred to as an intermediate suction flow) suctioned from the intermediate stage injection nozzle. Despite such a situation, the two flows are joined with each other in the return flow channel portion as they are. Therefore, the pressure loss of the fluid becomes larger at the joining section between the working gas and the intermediate suction flow.

For the aforementioned problem, in order to suppress the pressure loss, a means for joining the two gases of the working gas and the intermediate suction flow after matching the flow directions to each other by partitioning the working gas and the intermediate suction flow using the partition wall is conceived.

However, there is a need to change the radially inward flow to the axial flow in the multistage centrifugal compressor. Here, when joining the two gases just prior to changing the direction of flow, the shearing force is generated in the flow of two gases by a flow velocity difference between the flow of the working gas along the partition wall and the intermediate suction flow along the partition wall. That is, in a curved flow channel that changes the radially inward flow to the axial flow, the flow velocity of the gas becomes faster on the inside of the curve, and the flow velocity of the gas becomes slower on the outside of the curve. Accordingly, the flow velocity difference in the flow of two gases increases and the shearing force is generated. Therefore, the pressure loss of the fluid increases even more in this case.

An object of the present invention is to provide an intermediate intake-type diaphragm and a centrifugal rotating machine capable of improving operation efficiency by suppressing the pressure loss of the fluid caused by the addition of the intermediate suction flow.

Solution to Problem

In an intermediate intake-type diaphragm as an aspect according to the present invention for achieving the aforementioned object, an introduction flow channel for guiding a first fluid toward an impeller rotating about an axial line, an intermediate suction flow channel for guiding a second fluid toward the impeller, and a curved flow channel for guiding the first fluid and the second fluid toward the impeller are defined, the introduction flow channel extending from a radially outer side of an axial line to a radially inner side, the intermediate suction flow channel being adjacent to the introduction flow channel and extending from the radially outer side of the axial line to the radially inner side, the curved flow channel being connected to downstream sides of the introduction flow channel and the intermediate suction flow channel and extending so that an inner surface is curved from a position of connection with the introduction flow channel toward one side in the direction of the axial line, the diaphragm includes a flow-regulating vane that is provided in the introduction flow channel to regulate the first fluid to flow along the radial direction, and a partition wall that partitions the introduction flow channel and the intermediate suction flow channel in the direction of the axial line, wherein a radially inner end portion of the partition wall is located further on a radially inner side than a radially outer end portion of the flow-regulating vane, and further on a radially outer side than a boundary between the introduction flow channel and the curved flow channel.

With the aforementioned structure, even after matching the flow directions of the first fluid and the second fluid with each other, the two fluids are joined before changing the radially inward flow to the axial flow. Therefore, it is possible to join the two fluids while reducing the velocity difference between the two fluids.

Further, in the aforementioned intermediate intake-type diaphragm, a trailing edge portion of the flow-regulating vane may be formed to be bent in the radial direction toward the radially inner end portion, and the radially inner end portion of the partition wall may be located at a position where the trailing edge portion of the flow-regulating vane begins to follow along the radial direction.

With the aforementioned configuration, after the flow direction of the first fluid is regulated as the flow in the radial direction, the first fluid is immediately joined with the second fluid. That is, it is possible to join the two fluids, while matching the flow directions of the two fluids with each other. Therefore, it is possible to further reduce the pressure loss due to joining.

Further, in the aforementioned intermediate intake-type diaphragm, the radially inner end portion of the flow-regulating vane may be located further on the radially outer side than the radially inner end portion of the partition wall.

With the aforementioned configuration, the first fluid and the second fluid are joined, while reducing the turbulence of the first fluid generated at the radially inner end portion of the flow-regulating vane. Therefore, it is possible to further reduce the pressure loss due to joining.

Further, in the aforementioned intermediate intake-type diaphragm, a guide vane for regulating the second fluid to flow along the radial direction may be provided in the intermediate suction flow channel, and a position in the radial direction of the radially inner end portion of the guide vane may be different from a position in the radial direction of the radially inner end portion of the flow-regulating vane.

With the aforementioned configuration, one of the first fluid and the second fluid joins with the other fluid, while remaining the swirling component. Accordingly, since the joined fluid flows into the impeller, while remaining the swirling component in a direction opposite to the rotational direction of the impeller into which the fluids flow, it is possible to obtain a more head rise. Therefore, it is possible to design a centrifugal rotating machine in a more compact manner.

A centrifugal rotating machine as an aspect according to the present invention includes the intermediate intake-type diaphragm, and an impeller covered with the intermediate intake-type diaphragm to be relatively rotatable around an axial line with respect to the intermediate intake-type diaphragm.

With the aforementioned configuration, even after matching the flow directions of the first fluid and the second fluid to each other, before changing the radially inward flow to the axial flow, after the two fluids join, the fluid flow converted into the flow directed to one side in the axial direction flows into the impeller. Therefore, it is possible to join the fluids, while reducing the velocity difference between the two fluids.

A centrifugal rotating machine as an aspect according to the present invention includes a foremost stage impeller rotating about an axial line and a succeeding stage side impeller disposed on a downstream side of the foremost stage impeller; a foremost stage diaphragm in which an inlet flow channel configured to guide a first fluid from a radially outer side of the axial line toward a radially inner side is defined, the foremost stage diaphragm having an inlet guide vane having a vane that is provided in the inlet flow channel to regulate the first fluid and guides the regulated first fluid into the foremost stage impeller; and a succeeding stage side diaphragm in which a return flow channel configured to guide the first fluid discharged from the foremost stage diaphragm toward the radially inner side from the radially outer side of the axial line is defined, the succeeding stage side diaphragm having a return vane having a vane that regulates the first fluid discharged from the foremost stage diaphragm in the return flow channel and is provided in the same number and the same phase as the inlet guide vane to guide the regulated first fluid to the succeeding stage side impeller, wherein at least one diaphragm of the foremost stage diaphragm and the succeeding stage side diaphragm may be the intermediate intake-type diaphragm, at least one of the inlet flow channel and the return flow channel is the introduction flow channel, and at least one of the inlet guide vane and the return vane may be the flow-regulating vane.

The return vane is provided in the same number and the same phase as the inlet guide vane as in the aforementioned configuration. Accordingly, when the fluid, in which a difference in flow velocity toward the radially inner side occurs at each position on the concentric circumference centered on the rotary shaft by passing through the inlet guide vane, flows to the succeeding stage side and passes through the return vane of the succeeding stage side diaphragm, it is possible to suppress components having the different flow velocities toward the radially inner side from joining each other to the minimum.

Advantageous Effects of Invention

In the intermediate intake-type diaphragm and the centrifugal rotating machine, it is possible to suppress the pressure loss of the fluid flowing through the centrifugal rotating machine caused by the addition of the intermediate suction flow and to improve the operating efficiency.

DESCRIPTION OF EMBODIMENTS

Hereinafter, each embodiment of a centrifugal rotating machine 1 according to the present invention will be described in detail with reference to the accompanying drawings.

First Embodiment

Hereinafter, a centrifugal rotating machine according to a first embodiment of the present invention will be described in detail with reference to FIGS. 1 to 3.

Figure 1:
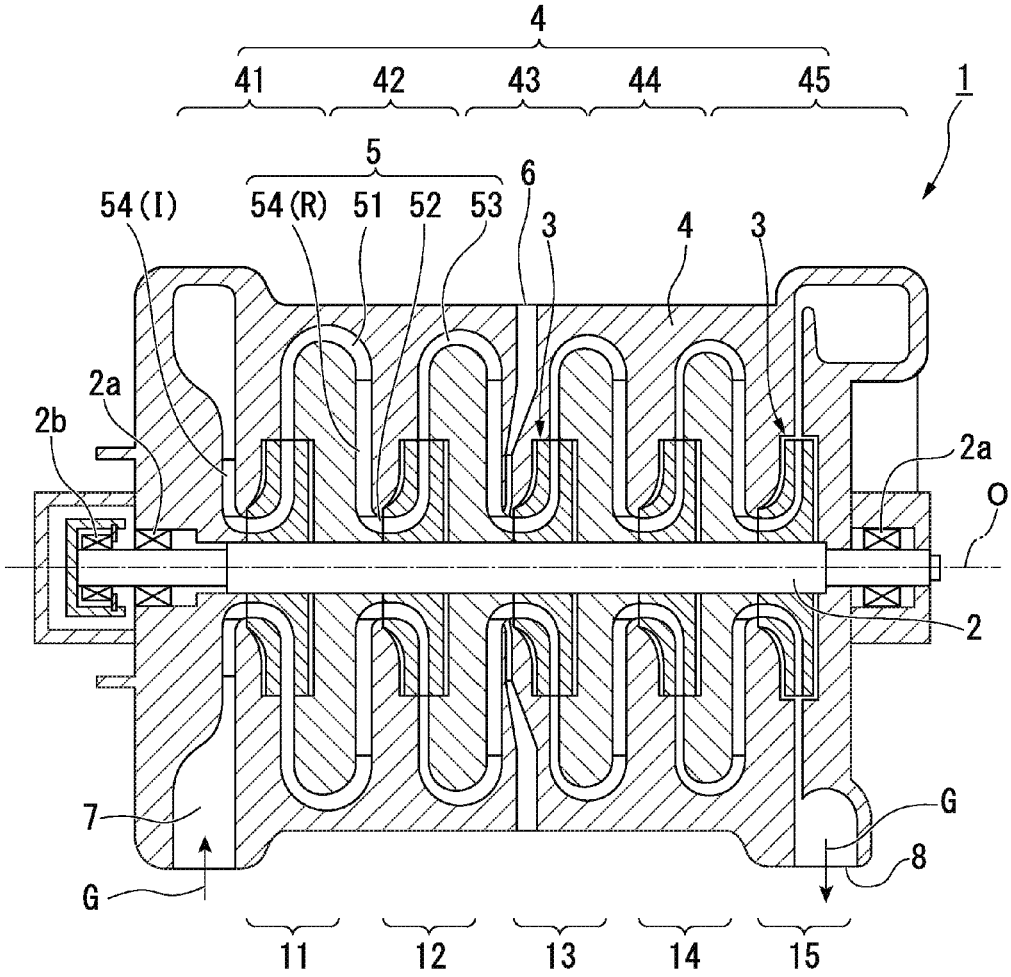
FIG. 1 is a cross-sectional view taken along an axial line of a centrifugal rotating machine of a first embodiment according to the present invention.

As illustrated in FIG. 1, a centrifugal rotating machine 1 of the present embodiment is, for example, a multistage centrifugal compressor. The centrifugal rotating machine 1 mainly includes a rotary shaft 2 which rotates about an axial line O, a plurality of impellers 3 which are attached to the rotary shaft 2 to compress a fluid G such as air or the like using centrifugal force, and a casing 4 which rotatably supports the rotary shaft 2, is formed with a flow channel 5 through which a fluid G flows from the upstream side to the downstream side and is formed with an external air introduction flow channel 6 for intermediate introduction of the external air or bleed air into the flow channel 5.

The rotary shaft 2 is formed in a cylindrical shape extending along the axial line O. The rotary shaft 2 is rotated about the axial line O by a power source such as an electric motor or the like (not illustrated).

The plurality of impellers 3 are arranged at intervals in the direction of the axial line O of the rotary shaft 2. Here, the centrifugal rotating machine 1 of the present embodiment includes five-stage compressor stages 11, 12, 13, 14 and 15 as a first stage compressor stage (foremost stage compressor stage) 11 to a fifth stage compressor stage (final stage compressor stage) 15 to correspond to the respective impellers 3 arranged in the direction of the axial line O.

Each of the impellers 3 is configured to have a disk-shaped hub of which a diameter is gradually enlarged toward a discharge port 8 side, a plurality of vanes which are radially attached to the hub and arranged in a circumferential direction, and a shroud which is attached to cover the tip sides of the plurality of vanes in the circumferential direction.

Further, each of the impellers 3 may be an open impeller having no shroud.

The casing 4 is formed with a substantially cylindrical outline. Also, the casing 4 includes a plurality of diaphragms 41, 42, 43, 44 and 45 corresponding to each of the compressor stages 11, 12, 13, 14 and 15 of the centrifugal rotating machine 1, and the rotary shaft 2 is disposed to pass through the center thereof. In other words, the casing 4 of the centrifugal rotating machine 1 of the present embodiment includes the five-stage diaphragms 41, 42, 43, 44 and 45 as a first stage diaphragm (a foremost stage diaphragm) 41 through a fifth stage diaphragm (a final stage diaphragm, a succeeding stage side diaphragm) 45 corresponding to the five-stage compression stages.

Further, journal bearings 2*a* are provided at both ends of the casing 4 in the direction of the axial line O of the rotary shaft 2, and a thrust bearing 2*b* is provided at one end thereof. The journal bearings 2*a* and the thrust bearing 2*b* rotatably support the rotary shaft 2. That is, the rotary shaft 2 is supported on the casing 4 via the journal bearings 2*a* and the thrust bearing 2*b*.

Among the diaphragms 41, 42, 43, 44 and 45, in the first stage diaphragm 41, a first external fluid suction port 7 which suctions (introduces) the fluid G from the outside of the centrifugal rotating machine 1 is defined on one end side in the direction of the axial line O, and the discharge port (outlet) 8 through which the fluid G flows out of the centrifugal rotating machine is defined in the fifth stage diaphragm. A flow channel 5 is defined in each of the diaphragms 41, 42, 43, 44 and 45, and the first external fluid suction port 7 defined in the first stage diaphragm 41 and the discharge port 8 defined in the fifth stage diaphragm 45 communicate with each other through the flow channel 5.

An introduction flow channel 51, a curved flow channel 52 and a discharge flow channel (a diffuser flow channel) 53 are defined in each of the diaphragms 41, 42, 43, 44 and 45. The introduction flow channel 51 guides the fluid from the radially outer side of the rotary shaft 2 toward the radially inner side. The curved flow channel 52 is connected to the downstream side of the introduction flow channel 51 and extends so that an inner surface is bent from a position connected to the introduction flow channel toward one side in the axial line O direction to guide the fluid G to the impeller 3. The discharge flow channel 53 guides the fluid G compressed by the impeller 3 from the radially inner side to the radially outer side to direct the fluid to the flow channel 5 of the succeeding stage side diaphragms 42, 43, 44 and 45. Furthermore, the diaphragms 41, 42, 43, 44 and 45 includes a flow-regulating vane 54 having a vane that is provided in the introduction flow channel 51 to regulate the fluid G suctioned from the outside.

The introduction flow channel 51 is a flow channel for sending the fluid G suctioned (introduced) from the radially outer side to the radially inner side. In the first stage diaphragm 41, the first external fluid suction port 7 for suctioning the fluid G (first fluid: G1) from the outside of the centrifugal rotating machine 1 to one end side in the direction of the axial line O is connected to the upstream side of the introduction flow channel 51. The introduction flow channel 51 of the first stage diaphragm 41 including the first external fluid suction port 7 is also referred to as an "introduction flow channel". An introduction flow channel of the diaphragms 42, 43, 44 and 45 of the succeeding stage side is also referred to as a "return flow channel". The fluid G compressed in the compressor stages 11, 12, 13 and 14 of the preceding stage flows into other introduction flow channels 51 of the diaphragms 42, 43, 44 and 45 of the succeeding stage side.

The curved flow channel 52 is connected to the downstream side of the introduction flow channel 51 and extends so that the inner surface is bent toward one side in the direction of the axial line O from a position connected to the introduction flow channel 51. Thus, the radially inward flow of the fluid G changes into the flow (flow of one side in the flow direction of the axial line O) directed toward the discharge port (outlet) 8 from the first external fluid suction port 7 in the direction of the axial line O. The fluid G of the flow changed into the flow to one side in the direction of the axial line O is guided to the impeller 3 and is compressed.

The discharge flow channel 53 guides the fluid G compressed by the impeller 3 from the radially inner side to the radially outer side, and leads the fluid to the flow channel 5 of the diaphragms 42, 43, 44 and 45 of the succeeding stage side.

Further, the discharge flow channel 53 in the fifth stage diaphragm 45 is different from other diaphragms 41, 42, 43 and 44 in that the discharge flow channel 53 guides the fluid G compressed by the impellers 3 of the compressor stage 11, 12, 13 and 14 of the preceding stage from the radially inner side to the radially outer side and leads the fluid G to the discharge port 8.

The flow-regulating vane 54 has a plurality of vanes (thin vanes) 54*a*. Since the vanes 54*a* are provided in the introduction flow channel 51, the vanes 54*a* regulate the fluid G suctioned (introduced) from the outside of the centrifugal rotating machine 1 or the fluid G compressed in the compressor stages 11, 12, 13 and 14 of the preceding stage to flow radially inward. Each vane 54*a* is formed so that a trailing edge portion 54*b* in the flow direction thereof follows along the radial direction toward a radially inner end portion 54*c*.

Here, the term "follows along the radial direction" indicates that a center line M in a width direction of the vane approaches parallelization with a line extending from the axial line O in the radial direction.

The flow-regulating vane 54 provided in the first stage diaphragm 41 is an inlet guide vane I capable of changing the angle of the vane by a mechanism (not illustrated), and the flow-regulating vane 54 provided in the succeeding stage side diaphragm is a return vane R in which the angle of the vane does not change. The vane 54*a* constituting the inlet guide vane I and the vane 54*a* constituting the return vane R may be provided in the same number and the same phase. In the present embodiment, the vanes are configured in this way.

Figure 2:
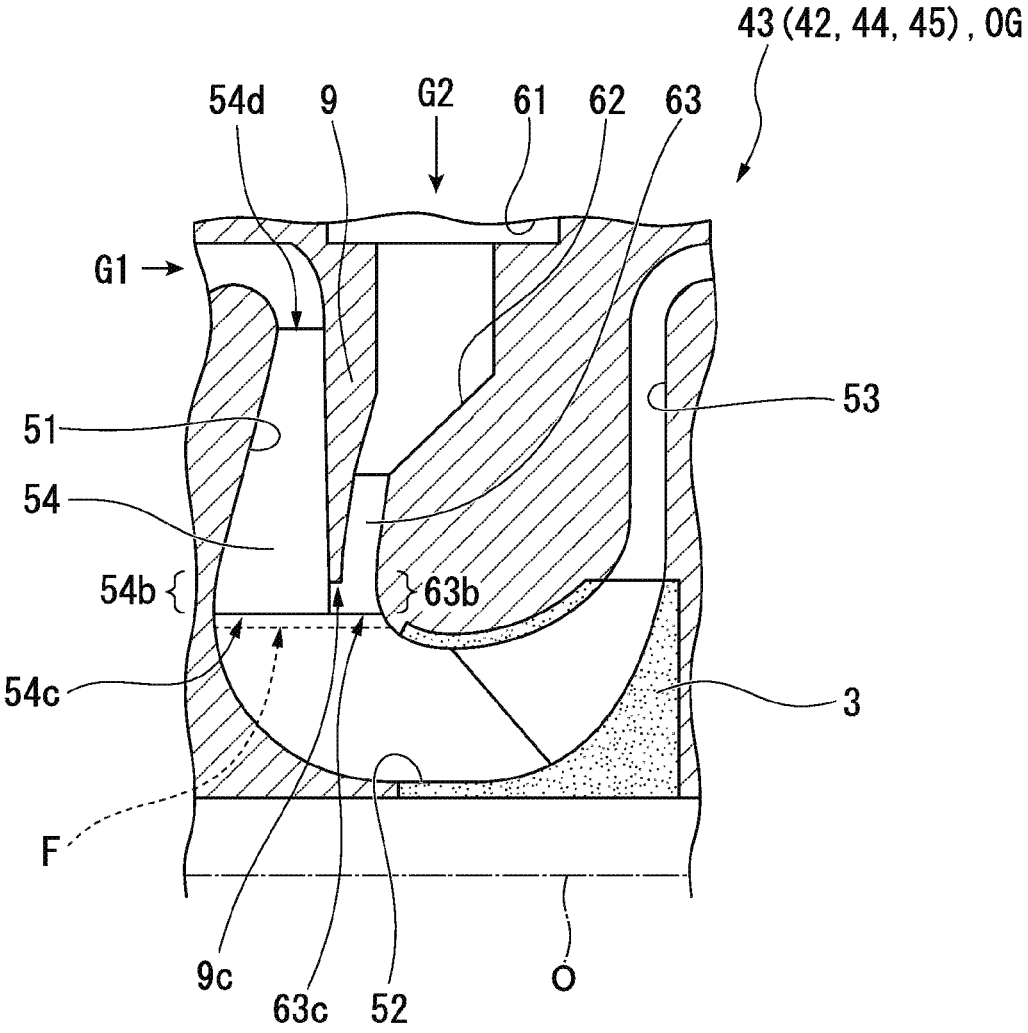
FIG. 2 is a cross-sectional view taken along an axial line of an intermediate intake-type diaphragm of the first embodiment according to the present invention.

As illustrated in FIG. 2, among the diaphragms 41, 42, 43, 44 and 45 that constitute the centrifugal rotating machine 1 of the present embodiment, at least one diaphragm (the third stage diaphragm 43 in the present embodiment) is an intermediate intake-type diaphragm OG. A second external fluid suction port 61 and an intermediate suction flow channel 62 are defined in the intermediate intake-type diaphragm OG. The second external fluid suction port 61 is formed separately from the first external fluid suction port 7 of the first stage diaphragm 41 to suction the fluid G from the outside, and the intermediate suction flow channel 62 is connected to the second external fluid suction port 61 on an upstream side and is connected to the curved flow channel on a downstream side. Furthermore, the intermediate intake-type diaphragm OG includes a guide vane 63 having vanes that are provided in the intermediate suction flow channel 62 to regulate the fluid G suctioned from the outside (the second external fluid suction port 61).

The second external fluid suction port 61 is defined to communicate with the outside of the casing 4 (the intermediate intake-type diaphragm OG) between the introduction flow channel 51 and the discharge flow channel 53 in the direction of the axial line O. The fluid G (the second fluid: G2) is suctioned from the second external fluid suction port 61 to the intermediate intake-type diaphragm OG.

The intermediate suction flow channel 62 is defined so that its upstream side is connected to the second external fluid suction port 61 and its downstream side is connected to the curved flow channel 52. The intermediate suction flow channel 62 is defined to be adjacent to the introduction flow channel 51, and the intermediate suction flow channel 62 and the introduction flow channel 51 are partitioned by the partition wall 9.

The partition wall 9 matches the directions of flow of fluids G1 and G2 flowing into the two flow channels of the introduction flow channel 51 and the intermediate suction flow channel 62 with each other, by partitioning the introduction flow channel 51 and the intermediate suction flow channel 62 in the direction of the axial line O. A radially inner end portion 9*c* of the partition wall 9 is located further on the radially inner side than the radially outer end portion 54*d* of the flow-regulating vane and further on the radially outer side than the boundary F between the introduction flow channel 51 and the curved flow channel 52.

Figure 3:
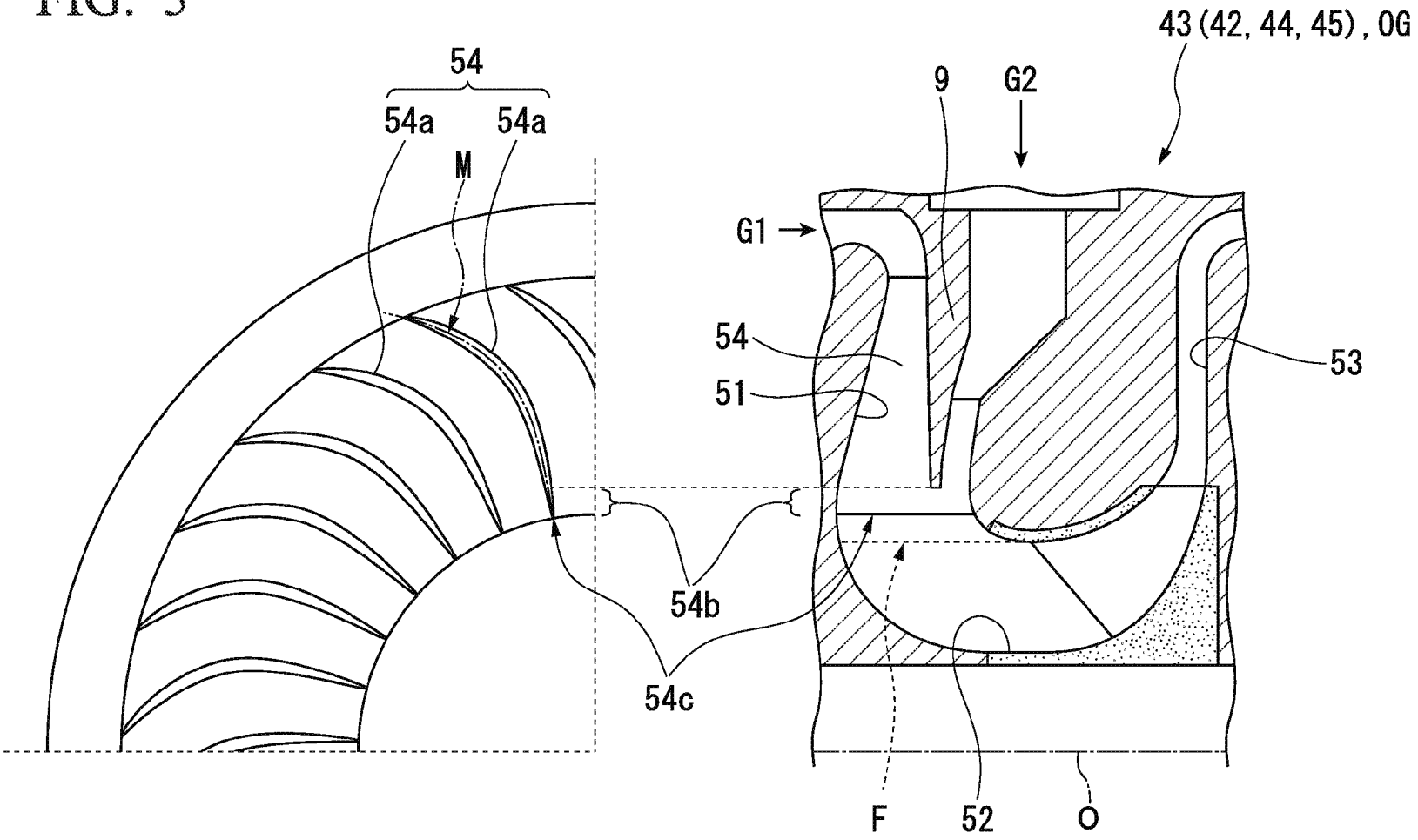
FIG. 3 is a cross-sectional view along an axial line and a cross-sectional view perpendicular to an axial line showing a relation between the intermediate intake-type diaphragm and the return vane of the first embodiment according to the present invention.

In this case, as illustrated in FIG. 3, the radially inner end portion 9*c* of the partition wall 9 may be located at a position where the trailing edge portion 54*b* of the flow-regulating vane 54 begins to follow along the radial direction. The present embodiment has such a configuration. The expression "position of beginning to follow along the radial position" refers to a position corresponding to the radially outermost point, among the positions where the center line M in the vane thickness (thickness along the radial direction) of the vane body is parallel to a line extending from the center axial line O in the radial direction.

The guide vane 63 has a plurality of vanes (thin vanes) 63*a*. Since the guide vane 63 is provided in the intermediate suction flow channel 62, the guide vane 63 regulates the fluid G (second fluid: G2) suctioned from the second external fluid suction port 61 to become a radially inward flow. Each vane 63*a* is formed so that the trailing edge portion 63*b* in its flow direction follows along the radial direction toward a radially inner end portion 63*c*. In the present embodiment, the position in the radial direction of the end portion 63*c* of the guide vane 63 is located at the same position in the radial direction of the end portion 54*c* of the flow-regulating vane 54.

As described above, the centrifugal rotating machine 1 of the present embodiment is provided with the second external fluid suction port 61, apart from the first external fluid suction port 7 provided in the first stage diaphragm 41. Therefore, the fluid G introduced from the first external fluid suction port 7 of the first stage diaphragm 41 or the first fluid G1 compressed by the impeller 3 after being introduced from the first external fluid suction port 7 of the first stage diaphragm 41 joins with the second fluid G2 that is introduced from the second external fluid suction port 61 and has the flow direction different from that of the first fluid G1.

The introduction flow channel 51 for guiding the first fluid G1 from the radially outer side to the radially inner side, and the intermediate suction flow channel 62 for guiding the second fluid G2 from the radially outer side (the second external fluid suction port) to the radially inner side are partitioned by the partition wall 9. Furthermore, the intermediate intake-type diaphragm OG is configured so that the radially inner end portion 9*c* of the partition wall 9 is located further on the radially inner side than the radially outer end portion 54*d* of the flow-regulating vane 54, and further on the radially outer side than the boundary F between the introduction flow channel 51 and the curved flow channel 52. Therefore, it is possible to join the two fluids G1 and G2 having mutually different flow directions after matching the flow directions to each other.

The two fluids G1 and G2 join on the upstream side of the curved flow channel 52 which is located at a position where the fluid flow begins to change from the radially inner flow to the flow on one side in the direction of the axial line O. Therefore, a flow velocity difference is less likely to occur between the flow along the partition wall of the first fluid G1 flowing in the introduction flow channel 51 and the flow along the partition wall of the second fluid G2 flowing in the intermediate suction flow channel.

Therefore, it is possible to suppress the pressure loss due to joining of the two fluids G1 and G2 when the flow directions are different and the pressure loss associated with the shearing force due to the velocity difference.

Furthermore, in the centrifugal rotating machine 1 of the present embodiment, the radially inner end portion 9*c* of the partition wall 9 is located further on the radially inner side than the radially outer end portion 54*d* of the flow-regulating vane 54 and further on the radially outer side than the boundary F between the introduction flow channel 51 and the curved flow channel 52 at the position where the trailing edge portion 54*b* of the flow-regulating vane 54 begins to follow along the radial direction. For this reason, after the flow direction of the first fluid G1 is regulated as a radial flow, the first fluid G1 is immediately joined with the second fluid G2.

Therefore, not only is it possible to regulate the flow direction of the first fluid G1 as the radial flow, it is also possible to suppress the pressure loss caused by joining of the first fluid G1 and the second fluid G2 to the minimum.

Further, in the centrifugal rotating machine 1 of the present embodiment, the vane 54*a* forming the inlet guide vane I and the vane 54*a* forming the return vanes R are provided in the same number and the same phase. Thus, by passing through the inlet guide vane I, when the fluid G in which a difference occurs in flow velocity in the radially inner side at each position on a concentric circumference centered on the axial line O passes through the return vanes R of the succeeding stage side diaphragms 42, 43, 44, and 45, it is possible to suppress the components having the different flow velocities to the radially inner side from joining at the return vane R to the minimum.

Therefore, the components of the first fluid G1 in which a difference in flow velocity is generated on the concentric circle can be suppressed from joining in the return vane R. Therefore, it is possible to suppress the pressure loss caused by the flow velocity difference on the concentric circle of the first fluid G1.

Second Embodiment

A second embodiment of the centrifugal rotating machine 10 according to the present invention will be described with reference to FIG. 4.

The second embodiment is different from the first embodiment in that the first stage diaphragm 410 is an intermediate intake-type diaphragm OG.

Figure 4:
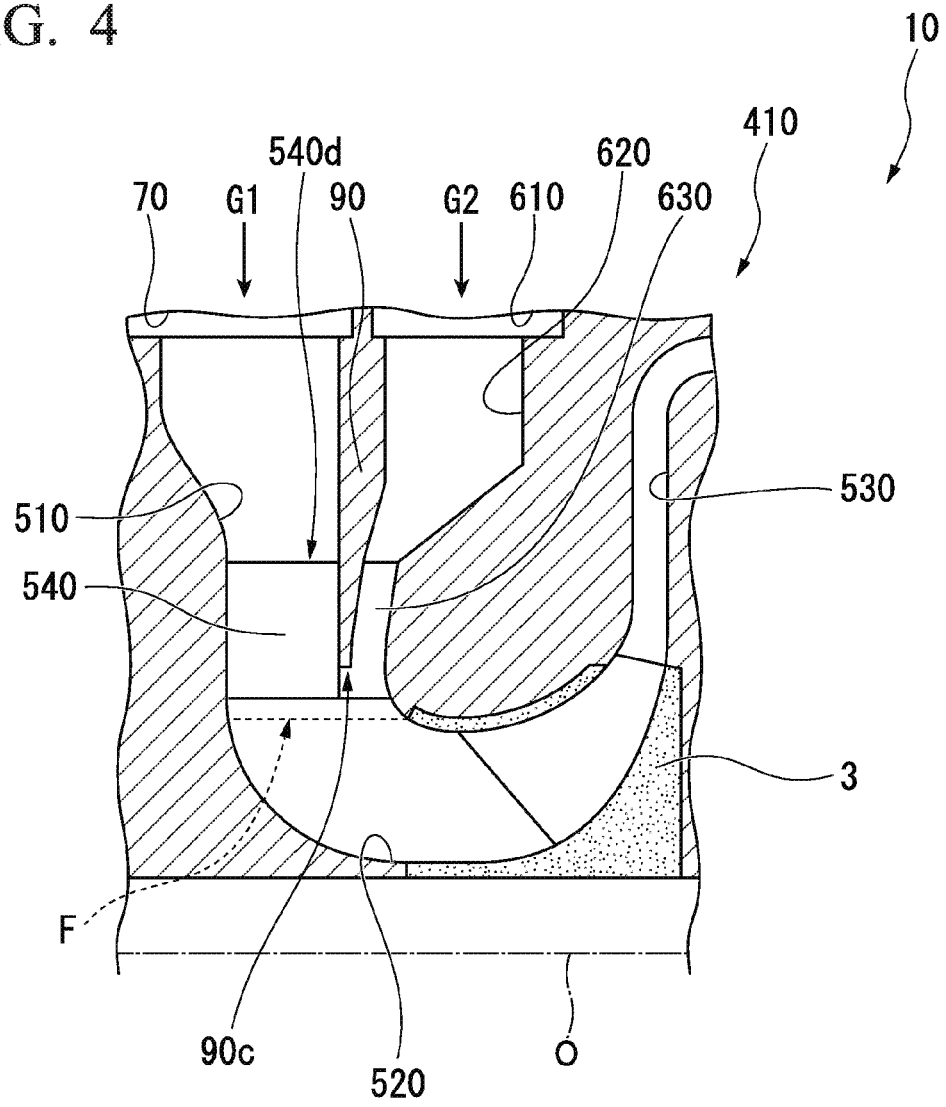
FIG. 4 is a cross-sectional view along the axial line of the intermediate intake-type diaphragm of a second embodiment according to the present invention.

As illustrated in FIG. 4, a first stage diaphragm 410 of the present embodiment is different from the first stage diaphragm 41 of the first embodiment. That is, a second external fluid suction port 610 and an intermediate suction flow channel 620 are defined in the first stage diaphragm 410. An upstream side of the intermediate suction flow channel 620 is connected to the second external fluid suction port 610, and a downstream side thereof is connected to a curved flow channel 520. The first stage diaphragm 410 includes a partition wall 90 which partitions an introduction flow channel 510 and the intermediate suction flow channel 620 in the direction of the axial line O, and a guide vane 630 which is provided in the intermediate suction flow channel 620 to regulate the fluid G2 suctioned from the outside (the second external fluid suction port 610).

As described above, since the centrifugal rotating machine 10 of the present embodiment is provided with the second external fluid suction port 610 apart from a first external fluid suction port 70 provided in the first stage diaphragm 410, the fluid G1 introduced from the first external fluid suction port 70 of the first stage diaphragm 410 and the second fluid G2 introduced from the second external fluid suction port 610 are joined.

The introduction flow channel 510 which guides the first fluid G1 from the radially outer side (the first external fluid suction port) to the radially inner side, and the intermediate suction flow channel 620 which guides the second fluid G2 from the radially outer side (the second external fluid suction port 610) to the radially inner side are partitioned by the partition wall 90. The first stage diaphragm 410 is configured so that a radially inner end portion 90*c* of the partition wall 90 is located further on the radially inner side than a radially outer end portion 540*d* of the flow-regulating vane 540 and further on the radially outer side than the boundary F between the introduction flow channel 510 and the curved flow channel 520. Therefore, even when joining the two fluids G1 and G2 by performing the intermediate suction of the second fluid G2 in the first stage diaphragm 410, it is possible to join the two fluids G1 and G2 after matching the directions of flow of the two fluids G1 and G2 having mutually different directions of flow.

The two fluids G1 and G2 are joined on the upstream side of the curved flow channel 520 located at a position where the flow of the fluids begin to change from the flow of the radially inner side to the flow toward one side in the direction of the axial line O. Therefore, a flow velocity difference is less likely to occur between the flow along the partition wall 90 of the first fluid G1 flowing through the introduction flow channel 510 and the flow along the partition wall 90 of the second fluid G2 flowing in the intermediate suction flow channel 620.

Thus, even when joining the two fluids G1 and G2 by performing the intermediate suction of the fluid G2 in the first stage diaphragm 410, it is possible to suppress the pressure loss due to joining of the two fluids G1 and G2 and the pressure loss associated with the shearing force caused by the velocity difference.

Figure 5:
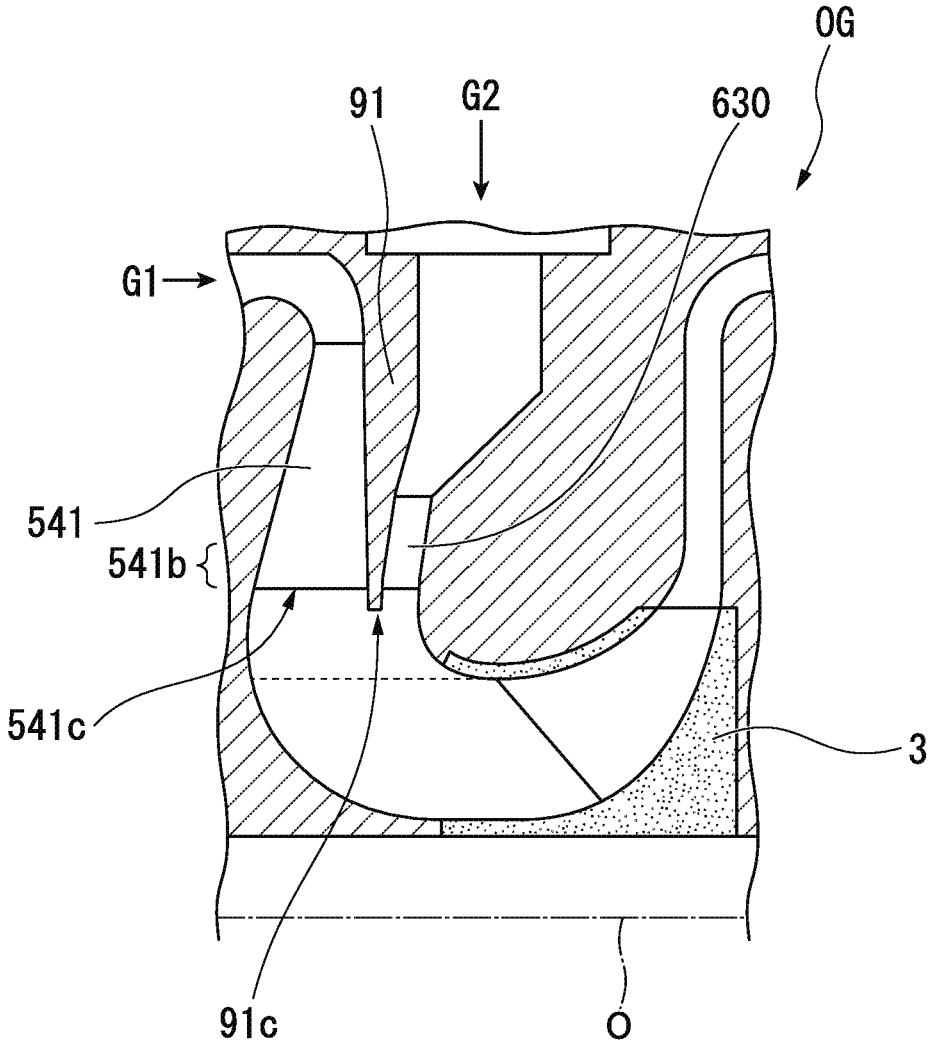
FIG. 5 is a cross-sectional view along the axial line of the intermediate intake-type diaphragm in a first modified example of each embodiment according to the present invention.

Although each embodiment of the present invention has been described above, the present invention is not limited to these embodiments. For example, as illustrated in FIG. 5, the intermediate intake-type diaphragm OG of the aforementioned embodiments may include a flow-regulating vane 541 in which a radially inner end portion 541*c* is located further on the radially outer side than a radially inner end portion 91*c* of a partition wall 91. Unlike the flow-regulating vane in the aforementioned embodiments, the flow-regulating vane 541 is formed so that the first fluid G1 becomes a flow while remaining the swirling components without sufficiently regulating the flow direction of the first fluid G1 as a radial flow, and the end portion 541*c* of the flow-regulating vane 541 is located further on the radially outer side than the end portion 91*c* of the partition wall 91.

With the aforementioned configuration, in a state of reducing the turbulence of the first fluid G1 generated at the end portion 541*c* of the flow-regulating vane 541, the first fluid G1 and the second fluid G2 are joined. Therefore, it is possible to further reduce the pressure loss due to joining.

Unlike the aforementioned embodiments, the trailing edge portion 541*b* of the flow-regulating vane 541 does not necessarily need to be formed to extend along the radial direction.

Figure 6A:
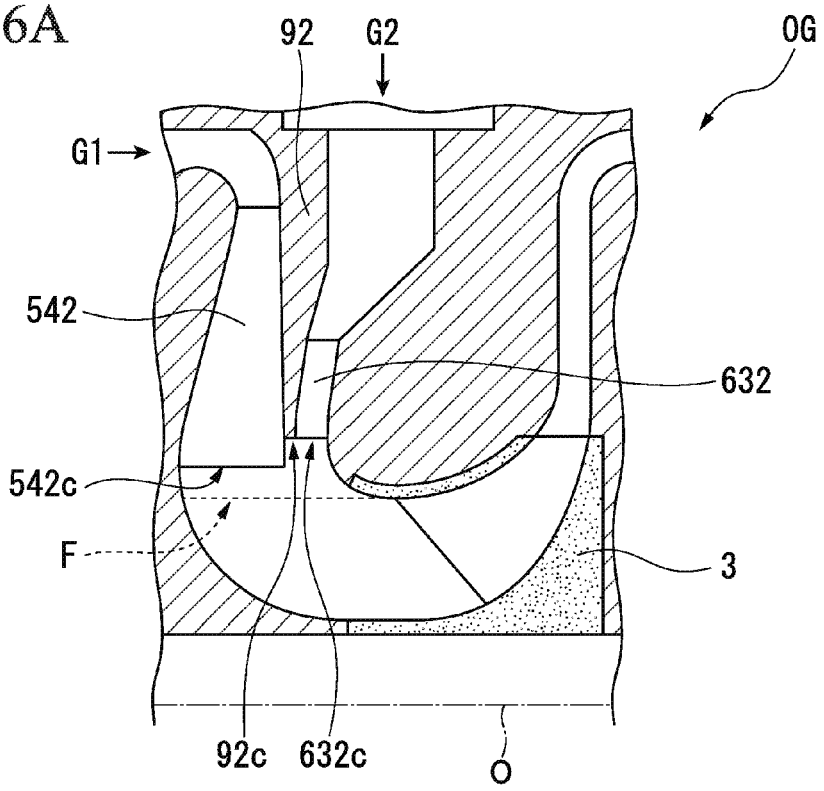
FIG. 6A is a cross-sectional view along the axial line of the intermediate intake-type diaphragm in a second modified example of each embodiment according to the present invention.
Figure 6B:
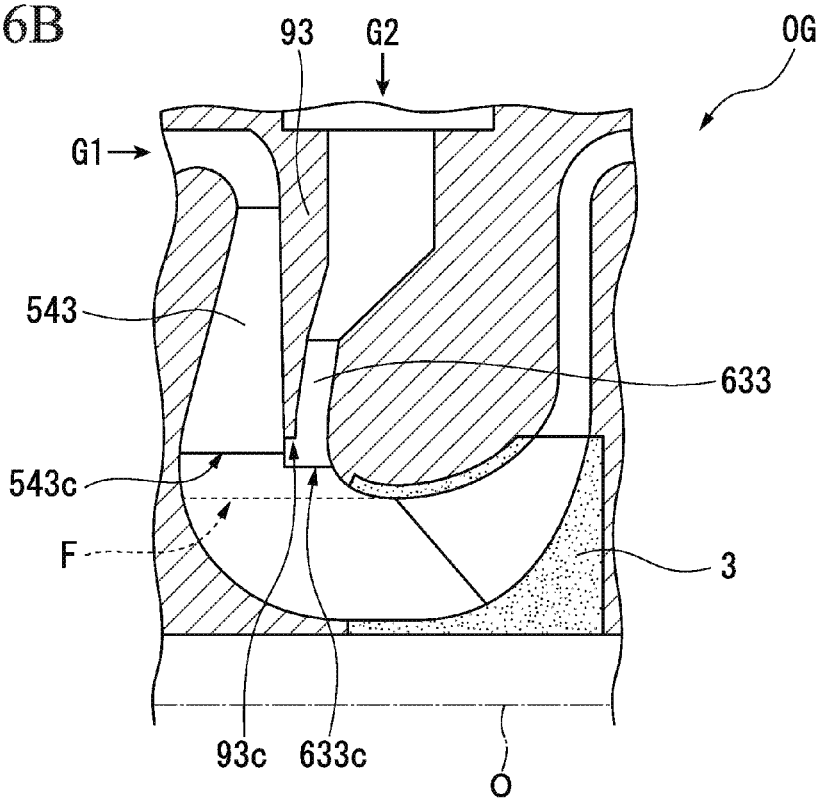
FIG. 6B is a cross-sectional view taken along the axial line of the intermediate intake-type diaphragm in a third modified example of each embodiment according to the present invention.

Further, as illustrated in FIGS. 6A and 6B, the intermediate intake-type diaphragm OG of the aforementioned embodiments includes guide vanes 632 and 633 in which the positions in the radial direction of radially inner end portions 632*c* and 633*c* of the guide vanes 632 and 633 are located further on the radially outer side (FIG. 6A) or further on the radially inner side (FIG. 6B) than the positions in the radial direction of radially inner end portions 542*c* and 543*c* of the flow-regulating vanes 542 and 543. That is, unlike the guide vanes 63 and 630 in the aforementioned embodiments, the positions in the radial direction of the radially inner end portions 632*c* and 633*c* of the guide vanes 632 and 633 are located at positions different from the positions in the radial direction of the radially inner end portions 542*c* and 543*c* of the flow-regulating vanes 542 and 543.

That is, the radially inner end portions 632*c* and 633*c* of the guide vanes 632 and 633 are formed at different positions from radially inner end portions 92*c* and 93*c* of the partition walls 92 and 93. Therefore, the second fluid G2 joins with the first fluid G1, while remaining the flow of swirling components in a state in which the flow direction of the second fluid G2 is not sufficiently regulated as the radial flow. Therefore, as compared to the aforementioned embodiments, the pressure loss occurs when the second fluid G2 joins with the first fluid G1. Meanwhile, since the swirl components remain in the joined fluid G, when the fluid G flows into the impeller 3 of the succeeding stage side, it is possible to obtain a head rise higher than the aforementioned embodiments. Therefore, it is possible to design a centrifugal rotating machine 1 in a more compact manner.

Further, embodiments obtained by combining each of the aforementioned embodiments may be adopted. As one of the embodiments obtained by combining each of the aforementioned embodiments, the first stage diaphragm 41 may be used as the intermediate intake-type diaphragm OG, and the succeeding stage side diaphragms 42, 43, 44 and 45 may be used as the intermediate intake-type diaphragm OG.

For example, although the multistage centrifugal compressor has been described as an example of the centrifugal rotating machine 1 in the aforementioned embodiments, it is possible to apply the intermediate intake-type diaphragm OG of the aforementioned embodiments to other centrifugal rotating machines such as a multistage centrifugal pump or the like that pumps a liquid fluid G.

INDUSTRIAL APPLICABILITY

With the intermediate intake-type diaphragm and the centrifugal rotating machine described above, it is possible to suppress the pressure loss of the fluid flowing through the centrifugal rotating machine caused by the addition of the intermediate suction flow and to improve the operating efficiency.

REFERENCE SIGNS LIST

2 Rotary shaft
3 Impeller
4 Casing
9, 90, 91, 92, 93 Partition wall
41, 42, 43, 44, 45 Diaphragm
54, 540, 541, 542, 543 Flow-regulating vane
63, 630, 632, 633 Guide vane

The invention claimed is:

1. An intermediate intake-type diaphragm in which an introduction flow channel, an intermediate suction flow channel, and a curved flow channel are defined, the introduction flow channel extending from a radially outer side of an axial line to a radially inner side to guide a first fluid toward an impeller rotating about the axial line, the intermediate suction flow channel being adjacent to the introduction flow channel and extending from the radially outer side of the axial line to the radially inner side to guide a second fluid toward the impeller, the curved flow channel being connected to downstream sides of the introduction flow channel and the intermediate suction flow channel and extending so that an inner surface is curved from a position of connection with the introduction flow channel toward one side in the direction of the axial line, and the curved flow channel guides the first fluid and the second fluid toward the impeller, the intermediate intake-type diaphragm comprising:

a flow-regulating vane that is provided in the introduction flow channel to regulate the first fluid to flow along the radial direction; and a partition wall that partitions the introduction flow channel and the intermediate suction flow channel in the direction of the axial line, wherein a radially inner end portion of the partition wall is located further on a radially inner side than a radially outer end portion of the flow-regulating vane and further on a radially outer side than a boundary between the introduction flow channel and the curved flow channel, a trailing edge portion of the flow-regulating vane is formed to be bent in the radial direction toward the radially inner end portion, and the radially inner end portion of the partition wall is located at a position where the trailing edge portion of the flow-regulating vane begins to follow along the radial direction.

2. A centrifugal rotating machine comprising:

the intermediate intake-type diaphragm according to claim 1; and the impeller covered with the intermediate intake-type diaphragm to be relatively rotatable around an axial line with respect to the intermediate intake-type diaphragm.

3. The intermediate intake-type diaphragm according to claim 1, wherein a guide vane configured to regulate the second fluid to flow along the radial direction is provided in the intermediate suction flow channel, and a position in the radial direction of a radially inner end portion of the guide vane is different from a position in the radial direction of the radially inner end portion of the of the flow-regulating vane.

4. An intermediate intake-type diaphragm in which an introduction flow channel, an intermediate suction flow channel, and a curved flow channel are defined, the introduction flow channel extending from a radially outer side of an axial line to a radially inner side to guide a first fluid toward an impeller rotating about the axial line, the intermediate suction flow channel being adjacent to the introduction flow channel and extending from the radially outer side of the axial line to the radially inner side to guide a second fluid toward the impeller, the curved flow channel being connected to downstream sides of the introduction flow channel and the intermediate suction flow channel and extending so that an inner surface is curved from a position of connection with the introduction flow channel toward one side in the direction of the axial line, and the curved flow channel guides the first fluid and the second fluid toward the impeller, the intermediate intake-type diaphragm comprising:

a flow-regulating vane that is provided in the introduction flow chat el to regulate the first fluid to flow along the radial direction; and a partition wall that partitions the introduction flow channel and the intermediate suction flow channel in the direction of the axial line, wherein a radially inner end portion of the partition wall is located further on a radially inner side than a radially outer end portion of the flow-regulating vane and further on a radially outer side than a boundary between the introduction flow channel and the curved flow channel, and the radially inner end portion of the flog-regulating vane is located her on the radially outer side than the radially inner end portion of the partition wall.

5. The intermediate intake-type diaphragm according to claim 4, wherein a guide vane configured to regulate the second fluid to flow along the radial direction is provided in the intermediate suction flow channel, and a position in the radial direction of a radially inner end portion of the guide vane is different from a position in the radial direction of the radially inner end portion of the of the flow-regulating vane.

6. An intermediate intake-type diaphragm in which an introduction flow channel, an intermediate suction flow channel, and a curved flow channel are defined, the introduction flow channel extending from a radially outer side of an axial line to a radially inner side to guide a first fluid toward an impeller rotating about the axial line, the intermediate suction flow channel being adjacent to the introduction flow channel and extending from the radially outer side of the axial line to the radially inner side to guide a second fluid toward the impeller, the curved flow channel being connected to downstream sides of the introduction flow channel and the intermediate suction flow channel and extending so that an inner surface is curved from a position of connection with the introduction flow channel toward one side in the direction of the axial line, and the curved flow channel guides the first fluid and the second fluid toward the impeller, the intermediate intake-type diaphragm comprising:

a flow-regulating vane that is provided in the introduction flow channel to regulate the first fluid to flow along the radial direction; and a partition wall that partitions the introduction flow channel and the intermediate suction flow channel in the direction of the axial line, wherein a radially inner end portion of the partition wall is located further on a radially inner side than a radially outer end portion of the flow-regulating vane and further on a radially outer side than a boundary between the introduction flow channel and the curved flow channel, a guide vane configured to regulate the second fluid to flow along the radial direction is provided in the intermediate suction flow channel, and a position in the radial direction of a radially inner end portion of the guide vane is different from a position in the radial direction of the radially inner end portion of the of the flow-regulating vane.

7. A centrifugal rotating machine comprising:

a plurality of impellers including a foremost stage impeller rotating about the an axial line and a succeeding stage side impeller disposed on a downstream side of the foremost stage impeller;

a foremost stage diaphragm in which an inlet flow channel configured to guide a first fluid from a radially outer side of the axial line toward a radially inner side is defined, the foremost stage diaphragm having an inlet guide vane having a vane that is provided in the inlet flow channel to regulate the first fluid and guides the regulated first fluid into the foremost stage impeller; and a succeeding stage side diaphragm in which a return flow channel configured to guide the first fluid discharged from the foremost stage diaphragm toward the radially inner side from the radially outer side of the axial line is defined, the succeeding stage side diaphragm having a return vane having a vane that regulates the first fluid discharged from the foremost stage diaphragm in the return flow channel and is provided in the same number and the same phase as the inlet guide vane to guide the regulated first fluid to the succeeding stage side impeller, wherein at least one diaphragm of the foremost stage diaphragm and the succeeding stage side diaphragm is an intermediate intake-type diaphragm, the intermediate intake-type diaphragm in which an introduction flow channel, an intermediate suction flow channel, and a curved flow channel are defined, the introduction flow channel extending from the radially outer side of the axial line to the radially inner side to guide the first fluid toward one of the plurality of impellers rotating about the axial line, the intermediate suction flow channel being adjacent to the introduction flow channel and extending from the radially outer side of the axial line to the radially inner side to guide a second fluid toward the one of the plurality of impellers, the curved flow channel being connected to downstream sides of the introduction flow channel and the intermediate suction flow channel and extending so that an inner surface is curved from a position of connection with the introduction flow channel toward one side in the direction of the axial line, and the curved flow channel guides the first fluid and the second fluid toward the one of the plurality of impellers, the intermediate intake-type diaphragm including:

a flow-regulating vane that as provided in the introduction flow channel to regulate the first fluid to flow along the radial direction; and a partition wall that partitions the introduction flow channel and the intermediate suction flow channel in the direction of the axial line, a radially inner end portion of the partition wall is located further on a radially inner side than a radially outer end portion of the flow-regulating vane and further on a radially outer side than a boundary between the introduction flow channel and the curved flow channel, a trailing edge portion of the flow-regulating vane is formed to be bent in the radial direction toward the radially inner end portion, and the radially inner end portion of the partition wall is located at a position where the trailing edge portion of the flow-regulating vane begins to follow along the radial direction, the inlet flow channel is the introduction flow channel, the inlet guide vane is the flow-regulating vane, and the one of the plurality of the impellers is the foremost stage impeller in the case where the foremost stage diaphragm is the intermediate intake-type diaphragm, and the return flow channel is the introduction flow channel, the return vane is the flow-regulating vane, and the one of the plurality of the impellers is the succeeding stage side impeller in case where the succeeding stage side diaphragm is the intermediate intake-type diaphragm.

* * * * *